US007121196B2

(12) United States Patent
Mellis

(10) Patent No.: US 7,121,196 B2
(45) Date of Patent: Oct. 17, 2006

(54) DEVICE AND METHOD FOR APPLYING PATTERNS AND/OR LABELS TO A SUBSTANTIALLY FLAT SURFACE OF AN ARTICLE

(76) Inventor: Horst Mellis, Weidkamp 118, 45355 Essen (DE)

( * ) Notice: Subject to any disclaimer, the term of this patent is extended or adjusted under 35 U.S.C. 154(b) by 0 days.

(21) Appl. No.: 10/710,603

(22) Filed: Jul. 23, 2004

(65) Prior Publication Data

US 2005/0028692 A1 Feb. 10, 2005

Related U.S. Application Data

(63) Continuation of application No. PCT/DE03/00204, filed on Jan. 27, 2003, now abandoned.

(30) Foreign Application Priority Data

Jan. 25, 2002 (DE) ..... 102 03 127
Mar. 22, 2002 (DE) ..... 102 13 028

(51) Int. Cl.
*B31F 1/07* (2006.01)
*B05C 17/08* (2006.01)

(52) U.S. Cl. ..... 101/32; 101/3.1; 101/126; 101/127.1; 434/87; 434/82; 33/564; 33/562

(58) Field of Classification Search ..... 101/3.1, 101/28, 32, 114, 126, 127, 127.1, 128.1; 434/85, 87, 88, 82; 33/501.45, 555, 562–566; 425/811, 105
See application file for complete search history.

(56) References Cited

U.S. PATENT DOCUMENTS 2,444,860 A * 7/1948 Summer ..... 101/115
3,244,093 A * 4/1966 Vasilantone ..... 101/126
3,633,286 A 1/1972 Maurer ..... 35/26
3,861,066 A * 1/1975 Klaja ..... 434/87
4,336,754 A 6/1982 Loeb ..... 101/127
4,799,317 A 1/1989 Christian et al. ..... 33/565
4,916,826 A 4/1990 McKeown ..... 33/564
5,100,324 A * 3/1992 Slayton ..... 434/87
5,127,321 A * 7/1992 Proffer ..... 101/115
5,372,506 A * 12/1994 Hambright ..... 434/84
5,511,472 A 4/1996 Taylor ..... 101/3.1
5,533,900 A * 7/1996 Volk ..... 434/87
6,494,134 B1 * 12/2002 Erdmann ..... 101/127.1
6,776,091 B1 * 8/2004 Goss ..... 101/128
2003/0118689 A1 * 6/2003 Carlson et al. ..... 425/811
2005/0031209 A1 * 2/2005 Browning et al. ..... 382/203

FOREIGN PATENT DOCUMENTS

DE 745113 12/1943
DE 2210925 9/1973

* cited by examiner

*Primary Examiner*—Leslie J. Evanisko
(74) *Attorney, Agent, or Firm*—Gudrun E. Huckett

(57) ABSTRACT

A device creating patterns on greeting cards and the like has at least one stencil for applying a pattern onto a flat surface. A stencil holder that has securing elements for securing the at least one stencil in a predetermined position relative to the stencil holder is provided. The stencil holder also has elements for positively securing the surface of the article onto which the pattern is to be applied relative to the stencil holder. The elements for securing the surface of the article are in the form of a recess that provides a positive securing action for the surface of the article alone or in combination with an adapter.

16 Claims, 4 Drawing Sheets

DEVICE AND METHOD FOR APPLYING PATTERNS AND/OR LABELS TO A SUBSTANTIALLY FLAT SURFACE OF AN ARTICLE

CROSS REFERENCE TO RELATED APPLICATIONS

This application is a continuation of International Application PCT/DE03/00204 with an international filing date of Jan. 27, 2003, not published in the English language under PCT Article 21(2), and now abandoned.

BACKGROUND OF INVENTION

1. Field of the Invention

The invention relates to a device and a method for applying patterns and/or labels to a substantially flat surface of an article, in particular, a postcard or greeting card, a leaf insert for photo albums, a certificate or the like, by employing a stencil.

2. Description of the Related Art

The terms postcard or greeting card are meant to include all conceivable types of greeting cards, invitation cards, message cards, congratulatory notes and the like. However, since devices and methods of the aforementioned kind are usually employed for producing hand-crafted greeting cards, often only the term card will be used in the following without this limiting the device and the method to cards in their literal sense. As a non-limiting example, certificates and leaf inserts for photo albums should be mentioned that can be processed in the same way by means of the device according to the invention and by means of the method according to the invention.

The term labels is used to include individual letters and numerals as well as complete greeting messages and congratulatory messages, for example, "Merry Christmas" or "Congratulations". For reasons of simplification, the term pattern will be generally used in the following wherein the term pattern is to include any type of ornamental design and labeling of any kind.

It has been known for some time that the application of patterns, particularly onto the surface of the aforementioned cards and the like, is done by employing stencils.

The stencils can be differentiated as follows: so-called single-layer stencils and two-layer or multi-layer stencils, wherein the two-layer or multi-layer stencils in fact are two or more separate stencils whose patterns supplement one another, in particular, in such a way that the bars or bridges of certain patterns, for example, those securing a central surface of a pattern e.g. in the case of the letter O, are not visible in the finished pattern.

It was found that many users have problems when using the single-layer as well as the multi-layer stencils.

An obvious problem in the case of multi-layer stencils that must be employed sequentially is the required alignment of a stencil that is applied at a later time relative to the pattern that has been created by using the first stencil. In the past, this has been done in such a way that onto the surface that has been processed or is to be processed by means of the stencil, i.e., generally a sheet of paper or cardboard, the position of the first stencil is marked by pencil and additional stencils are then aligned later on relative to these pencil markings. This method is however imprecise because it allows only an approximate alignment that is purely based on visual estimation of the second and any additional stencil relative to the pencil markings. Moreover, when removing the pencil markings, there are usually erasure marks visible on the surface, in particular, because the paper or cardboard that is to be processed is sensitive with regard to mechanical wear and can be easily damaged upon using an eraser for removing the markings.

In the case of single-layer stencils, the alignment of the stencil relative to the card is a problem for many users because the number of design possibilities as a result of free choice regarding the positioning of the stencil relative to a card is perceived by many users as a disadvantage rather than an advantage. This problem also occurs in regard to multi-layer stencils because the first stencil can be freely positioned relative to the card.

At least a partial solution of the problems in regard to working with stencils is proposed in DE 1 954 970 A1. This reference discloses a device with which multi-layer stencils and particularly a stencil on which several elements to be applied sequentially are provided for producing a pattern can be secured in certain positions relative to a frame. However, this does not relieve the user from the free choice with regard to the arrangement of the pattern relative to a card; a limitation is provided only in the case where punched cards are used that can be fixed on the frame. The device therefore is not suitable for producing high-quality greeting cards that are to be free of punched holes.

DE 2 210 925 A1 discloses a stencil and a stencil holder for labeling elongate textile webs, in particular, laundry identification labels, wherein the web to be labeled is guided at the top and bottom edges by the stencil holder. In this arrangement, there is also the problem of free choice because the individual stencils can be positioned in a longitudinal direction of the web at any location.

SUMMARY OF INVENTION

It is an object of the present invention to provide a device and a method for applying patterns and/or labels onto a substantially flat surface of an article, in particular, a postcard or greeting card, a leaf insert for photo albums, a certificate or the like, by using stencils which device and method enable, not only for multi-layer stencils, an exact alignment of each stencil, by which a pattern and/or label is to be transferred onto a surface, relative to the surface onto which the pattern or the label is to be transferred, but also relieve the user, as needed, practically of any free choice with regard to the alignment of the pattern relative to the surface.

This object is solved by a device comprising at least one stencil and a stencil holder, wherein the stencil holder has means for securing a predetermined position of the at least one stencil relative to the stencil holder and means for positively securing a predetermined position of the surface, onto which by means of the stencil a pattern and/or label is to be applied, relative to the stencil holder, and wherein the means for positively securing a predetermined position of the surface, onto which by means of the stencil a pattern and/or label is to be applied, relative to the stencil holder comprise a recess (depression) in the stencil holder that, depending on the size of the surface to be processed, enables either directly the desired positive engagement or into which recess (depression) an adapter is insertable for adjusting the recess (depression) to the surface to be processed.

The object is moreover solved by a stencil holder for the device of the present invention, wherein the stencil holder comprises means for securing a predetermined position of a stencil relative to the stencil holder and means for positively securing a predetermined position of the surface, onto which by means of the stencil a pattern and/or label is to be applied, relative to the stencil holder, wherein the means for positively securing a predetermined position of the surface, onto which by means of a stencil a pattern and/or label is to be applied, relative to the stencil holder comprise a recess or depression in the stencil holder that, depending on the size of the surface to be processed, enables either directly the desired positive engagement or into which recess or depression an adapter is insertable for matching the recess or depression to the surface to be processed.

The object is moreover solved by an adapter for the device of the present invention wherein the adapter is configured for matching the means for securing a predetermined position of the surface, onto which by means of the stencil a pattern and/or label is to be applied, relative to the stencil holder to a certain size of articles, in particular, a standard paper size.

The object is moreover solved by a method for applying patterns and/or labels onto a substantially flat surface of an article, in particular, a postcard or greeting card, a leaf insert for photo albums, a certificate or that liked by employing at least one stencil and the stencil holder, wherein the stencil holder has means for positively securing a predetermined position of the at least one stencil relative to the stencil holder and means for securing a predetermined position of the surface, onto which by means of the stencil a pattern and/or label is to be applied, relative to the stencil holder, wherein the method comprises the steps of inserting an article with the surface to be processed into the stencil holder and positively securing a predetermined position of the surface, onto which by means of the stencil the pattern and/or label is to be applied, relative to the stencil holder by means of a recess or depression in the stencil holder, which recess, depending on the size of the surface to be processed, either directly enables the desired positive engagement or into which an adapter for adjustment of the recess or depression to the surface to be processed is inserted; placing a stencil onto the stencil holder and the surface to be processed in a predetermined position relative to the stencil holder; and applying the pattern.

DETAILED DESCRIPTION

Figure 1:
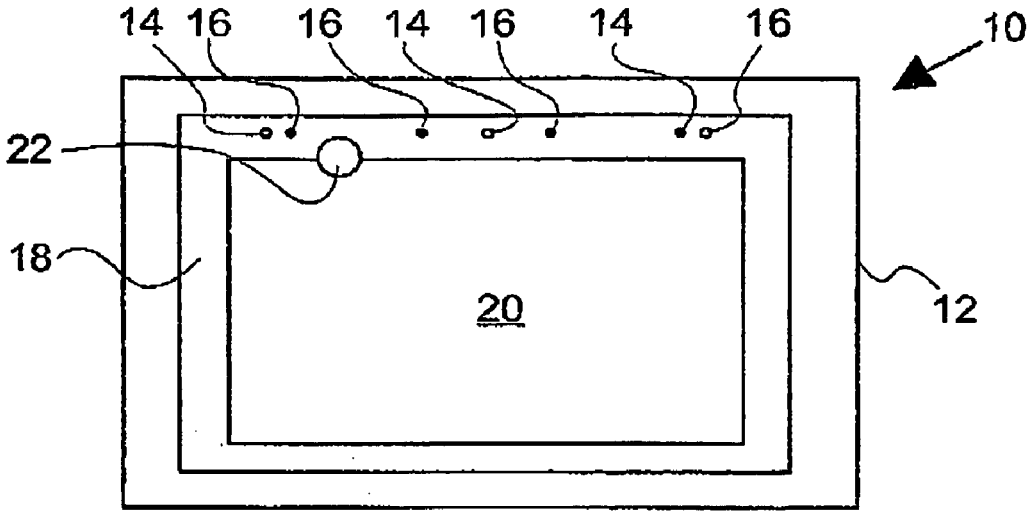
FIG. 1 shows a stencil holder for securing a stencil and for receiving a card to be processed having a first card size.
Figure 2:
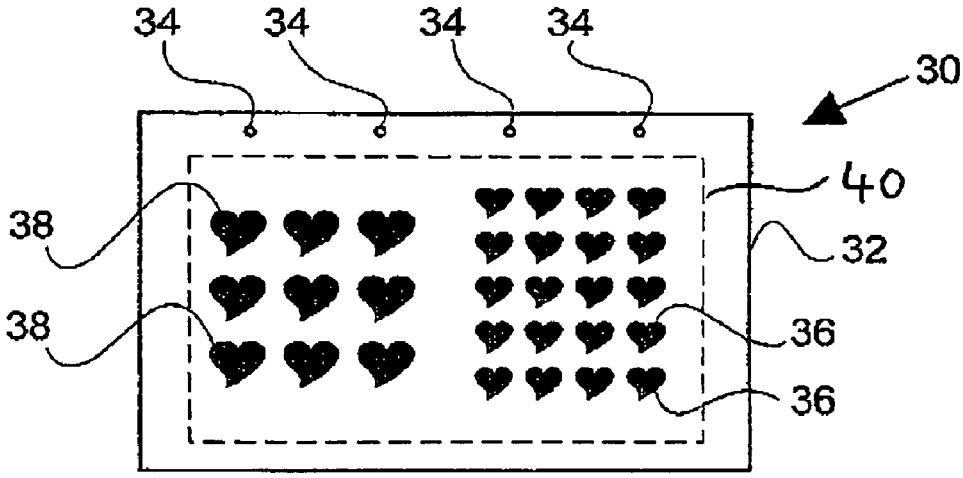
FIG. 2 shows a stencil for producing two different basic patterns, i.e., a basic pattern with 20 heart shapes and a pattern with nine heart shapes.

The stencil holder 10 shown in FIG. 1 is designed for holding a stencil, for example, a stencil as the one shown in FIG. 2, and for receiving an article having a surface to be processed. The article with the surface to be processed will generally be a card.

The stencil holder 10 comprises in this embodiment a base member in the form of a base plate or work plate 12 in which in this embodiment seven receiving openings 14 are provided. FIG. 1 shows only three receiving openings that are identified by reference numerals because the other four receiving openings have inserted therein short securing pins 16 so that these four receiving openings in the plan view illustrated in FIG. 1 appear filled.

The securing pins 16 can be, for example, short sections of a cylindrical rod or double cone-shaped shelf supports as they are known in the furniture industry. These purely exemplary shapes of securing pins have each a round cross-section so that the receiving openings 14 also have a round cross-section.

It should be mentioned in this connection that the receiving openings 14, of course, can have any suitable other cross-sectional shape, for example, a triangular or rectangular shape. Of course, in this case the securing pins 16 should have a matching cross-sectional shape so that they can be secured positively in the receiving openings 14.

The securing pins 16 project upwardly from the stencil holder 10 so that a stencil that is provided with corresponding perforations can be placed onto the stencil holder such that the stencil is positioned in an exactly predetermined position relative to the stencil holder. The precise method of using the stencil holder and stencil will be explained in more detail in the following.

The stencil holder 12 can be manufactured of any suitable material. Visually pleasing stencil holders can be manufactured, for example, from hard plastic materials such as acrylic glass.

The illustrated embodiment has several receiving openings 14 for short securing pins for securing stencils; this makes it possible that the securing pins can be inserted in different positions on the stencil holder, and this fulfills two functions.

On the one hand, the stencils provided in different countries have generally differently positioned perforations; these perforations originally are not provided for securing the stencil on a stencil holder but instead serve for archiving the stencils. The invention therefore can use advantageously perforations that are already present in the stencils. When the stencils are without perforations, the desired perforations can be produced easily in the stencils.

Stencils manufactured in Germany have generally a double or quadruple perforation with a spacing of 8 cm between the holes. In contrast to this, stencils manufactured in the United States of America have usually a three hole perforation. With a corresponding arrangement of the receiving openings 14 on the stencil holder 10, the different kinds of perforations of the stencils can be taken into account.

It is, of course, also possible to provide differently shaped or differently sized receiving openings into which matching differently shaped and/or differently sized securing pins can be inserted; the perforations of the stencils made in the United States of America have usually a greater diameter than the perforations usually employed in Germany.

On the other hand, it is possible to secure a stencil in different positions relative to the surface to be processed, for example, in landscape format or portrait format, when an appropriate arrangement of the receiving openings in conjunction with an appropriate configuration of the stencil holder is provided. This functionality is not provided in connection with the stencil holder illustrated in FIG. 1.

It should be noted in this context that the securing pins 16, of course, can also be connected fixedly to the stencil holder so that they cannot be removed and reinserted in different positions. Also, the securing pins can be integral (monolithic) components of the stencil holder that are directly formed on the stencil holder.

The securing pins 16 form means for securing a predetermined position of a stencil relative to the stencil holder. Such means can also be provided in different ways, for example, by providing appropriate stops for the stencils.

The stencil holder 10 has in this embodiment moreover a first recess 18 and a second recess 20. In this connection, the first recess 18 is matched to the size of the stencils that are usually employed in connection with the stencil holder, in particular, with regard to their length and width as well as with regard to their height, so that an inserted stencil forms advantageously a flush working surface together with the topside of the stencil holder from which surface only the securing pins 16 project upwardly.

The circumferential edges of the first recess 18 form a stop for the edges of the stencil. When the stencil is advantageously sized such that the length of its outer edges matches exactly the length of the inner edges of the recess 18, the stencil can be secured positively in the stencil holder. The edges of the first recesses 18 form thus means for securing a predetermined position of a stencil relative to the stencil holder. Theoretically, the securing pins 16 can be omitted in this configuration.

The securing pins ensure however that a stencil, like the stencil illustrated in FIG. 2, can be placed only in certain positions relative to the stencil holder, for example, the stencil illustrated in FIG. 2 can be placed onto the holder only such that the tips of the heart shapes in the drawing face downwardly. In this way, the device is practically foolproof with regard to its operation.

The second recess (depression) 20 is matched with regard to its width, length, and depth to the size of the articles that are usually to be processed. Since the articles to be processed are generally so-called folded cards that are made of a folded sheet of sturdy paper or thin cardboard and in Germany often have the size DIN A5 in the folded state, a stencil holder to be used exclusively on the German market will have a recess 20 generally matching the format DIN A4 so that the card in the open state can be placed into the recess 20. In other countries with other country-specific sizes of cards, the recesses 20 are therefore sized according to an appropriate different format.

In principle, it was found to be expedient to configure the recess 20 such that it can receive cards, leaf inserts, certificates etc. matching the largest size that is typical for a country and to then provide one or several adapters with which the size of the recess can be matched to smaller sizes. Such adapters will be explained in the following in more detail.

The edges of the recess 20 form a stop for the edges of the article to be processed so that the recess 20 provides a means for securing a predetermined position of the surface to be processed, i.e., the surface of an article onto which by means of the stencil a pattern and/or a label is to be applied, relative to the stencil holder. As mentioned above, by means of the securing pins 16, or optionally already by the recess 18 alone, the position of the stencil relative to the stencil holder can be exactly determined, and the stencil holder enables to precisely secure the position of the stencil relative to the surface to be processed.

It should be mentioned in this connection that the recess 20 can also be a cutout so that the stencil holder is only a frame but not a support surface for the article to be processed. This is possible without problems because the devices of the kind in question are generally placed onto a flat working surface/support. The article to be processed, for example, a postcard, would then be placed directly onto such a working surface and would only be laterally surrounded by the frame-shaped stencil holder.

Both configurations have advantages. A stencil holder in the form of a frame is significantly lighter and, as a result of material savings, generally also less expensive than a stencil holder having a support surface for the article to be processed. On the other hand, a stencil holder with a support surface is generally more stable in regard to the article to be processed in comparison to a simple frame. Moreover, when using an open frame, particularly a thin card or a thin sheet of paper can easily become displaced when the frame is not pressed firmly against the working surface. Also, a stencil holder, in which the bottom of the recess itself provides a working surface or support for the article to be processed, protects a table or the like on which the stencil holder is placed from becoming soiled or damaged when working with the device.

A further variant proposes projections in place of recesses or depressions. Like the above described solutions, such projections enable also a positive-locking securing of a card or sheet of paper in the stencil holder without the card or the paper becoming damaged, i.e., without the card or the paper having to be folded or punched.

The stencil holder 10 has in this embodiment a continuous opening 22 so that an inserted stencil and/or inserted article to be processed, for example, a card, can be pushed from the backside of the stencil holder forwardly so that the stencil and/or article can be removed easily out of the stencil holder.

In FIG. 2, a stencil 30 is illustrated for applying patterns onto e.g. greeting cards. The stencil 30 is comprised of a base 32 that is stiff or flexible and depending on the type and use of the stencil can be designed to be disposable or reusable. For a disposable configuration, such a stencil can be made of paper or cardboard. In general, the stencil is produced of a plastic film or thin plastic sheet.

A number of perforations 34 is provided in the base 32 wherein the perforations with regards to their size, number and shape are matched to the securing pins 16 of the stencil holder 10. Moreover, various pattern cutouts 36 and 38 are provided within the base 32, wherein, for reasons of simplification, only some are identified by reference numerals. It should be noted in this connection that the pattern cutouts 36 and 38 are filled in solid black for illustration purposes only in FIG. 2 and that the pattern cutouts 36 and 38, in fact, are openings, for example, stamped out or cut out by laser from the base 32.

The stencil 30 in this embodiment is designed such that a conventional folded card whose format in the unfolded state is illustrated by the dashed line 40 can be provided with two different basic patterns: one consisting of 20 heart shapes and the other of nine heart shapes.

Conventionally, a folded card is provided with a basic pattern only on the part that forms the front side in the folded state. Into the so-called inner sides of the card, text is written. In the unfolded state of a folded card, having in the unfolded state the size indicated by the dashed line 40, the front side of the card, when the dashed line 40 indicates the card, would be located underneath the pattern cutouts 36 shown in the left area of FIG. 2.

When processing a folded card of this size, the following steps are carried out: the card is inserted in the unfolded state into the recess 20 of the stencil holder 10 and, subsequently, the stencil 30 is inserted into the recess 18 of the stencil holder 10. Subsequently, for example, by means of a brush or a pen, color is applied via the pattern cutouts 36 onto the front side of the card. In this way, 20 heart-shaped patterns can be generated on the front side of the card. If the other basic pattern provided on the stencil 30 and having nine heart patterns is to be applied onto the front side of the card, the stencil would only have to be turned about an axis that extends in the plane of the drawing from the top to the bottom.

Figure 3:
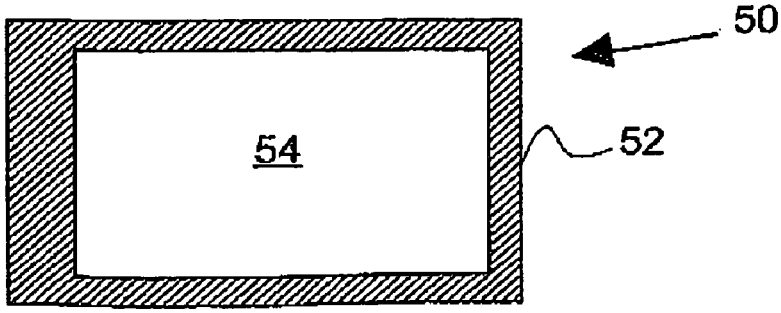
FIG. 3 shows an adapter for adapting the stencil holder illustrated in FIG. 1 to a second card size.

In FIG. 3, an adapter 50 is illustrated which serves to match the recess 20 in the stencil holder 10 to a different size of an article to be processed, for example, to a smaller paper size.

The adapter 50 is comprised in this embodiment of a base element in the form of a circumferential frame 52 having a receiving opening 54. The frame 52 is matched with regard to width, length, and thickness to the recess 20.

The receiving opening 54 matches the format to which the recess 20 is to be reduced in the stencil holder 10.

Figure 3A:
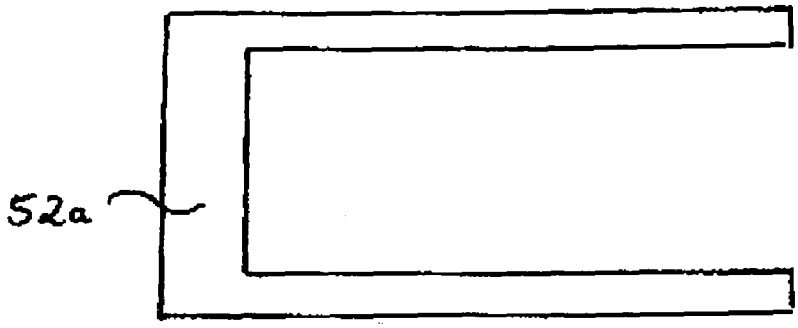
FIG. 3*a* shows an adapter in the form of a U-shaped frame to be inserted into the recess for the article.
Figure 3B:
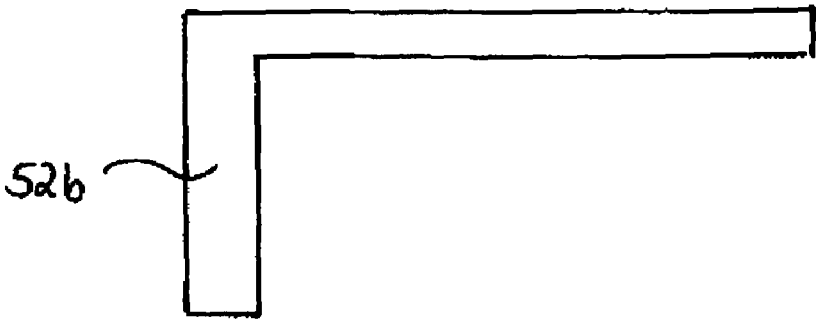
FIG. 3*b* shows an adapter in the form of an angled piece to be inserted into the recess for the article.
Figure 3C:
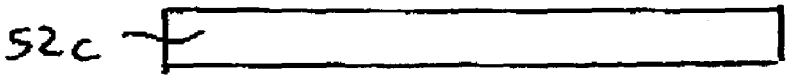
FIG. 3*c* shows an adapter in the shape of a long bar for the long side of the recess for the article.
Figure 3D:
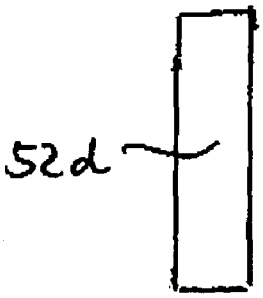
FIG. 3*d* shows an adapter in the short bar for the short side of the recess for the article.

It should be noted in this context that in place of the circumferential continuous frame 52, depending on the type of desired reduction of the recess 20, also differently shaped adapters can be provided. When the recess 20 is to be reduced only with regard to its width, the corresponding adapter can be designed in the form of a flat bar 52*d* of a corresponding width (FIG. 3*d*). A reduction with regard to height can be achieved by a bar 52*c* placed at the bottom or top side of the recess 20.

The reduction with regard to width and length can be obtained also by an angular adapter frame 52*b* (see FIG. 3*b*) so that the recess 20 is reduced in the stencil holder at one side representing the length and one side representing the width. A U-shaped adapter frame 52*a* (see FIG. 3*a*) reduced the size of the recess on three sides. Frame-shaped adapters as illustrated in FIG. 3 that reduce the recess 20 circumferentially by a certain amount, enable however to place the receiving opening 54 such that no specially matched stencils must be used.

When an angled adapter is inserted into the recess 20 of the stencil holder illustrated in FIG. 1 in such a way that it would extend along the left edge and upper edge of the recess 20, a card inserted into the remaining recess and matched to this size would then be moved to the right edge and lower edge of the recess 20. When a stencil 30 as the one illustrated in FIG. 2 is placed thereon, the basic pattern formed by the pattern cutouts 36 would no longer be centered above the right half of the card that in the folded state would form the front side of the card.

A circumferential adapter as the one illustrated in FIG. 3, on the other hand, enables to align the card surface to be processed relative to the stencil such that the center of a basic pattern will always be aligned with the center of the card surface to be processed.

The rectangular receiving opening 54 in the adapter as illustrated in the drawing can, of course, have any other shape, for example, a circular or oval shape. Also, in place of the through opening, it is possible to provide only a recess or depression in a plate-shaped adapter in which recess or depression the surface of the article to be processed is received. It is only important that the adapter advantageously enables purely positive fixation of the article to be processed, for example, a card, without having to damage the article in any way, for example, by folding.

Figure 4:
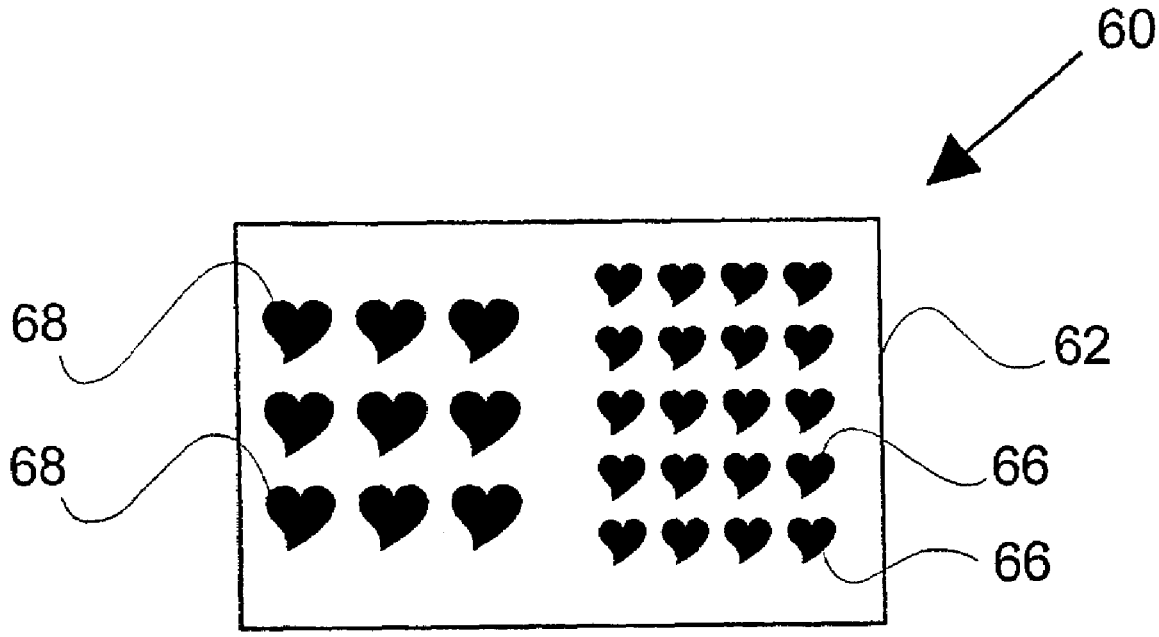
FIG. 4 shows a stencil for use in combination with the stencil according to FIG. 2 for producing two different embossed patterns.

Embossed patterns can be created when the embossing stencil 60 as illustrated in FIG. 4 is used in combination with the stencil of the kind illustrated in FIG. 2 that, in combination with embossing stencil 60, also acts as an embossing stencil. The stencil 60 is comprised of a base 62 that is stiff or flexible and, depending on the type and purpose of the stencil, can be disposable or reusable. For a disposable use, such a stencil can be made of paper or paper board or cardboard. In general, the stencil is produced from plastic film or a thin plastic sheet.

The base 62 is provided with different pattern cutouts 66 and 68 of which, for reasons of simplification, only some are provided with reference numerals. The pattern cutouts 66 and 68 are filled in solid black only for demonstration purposes in FIG. 4. In fact, these pattern cutouts 66 and 68 are, for example, openings in the base element 62 that are stamped out or cut out by a laser.

Figure 5:
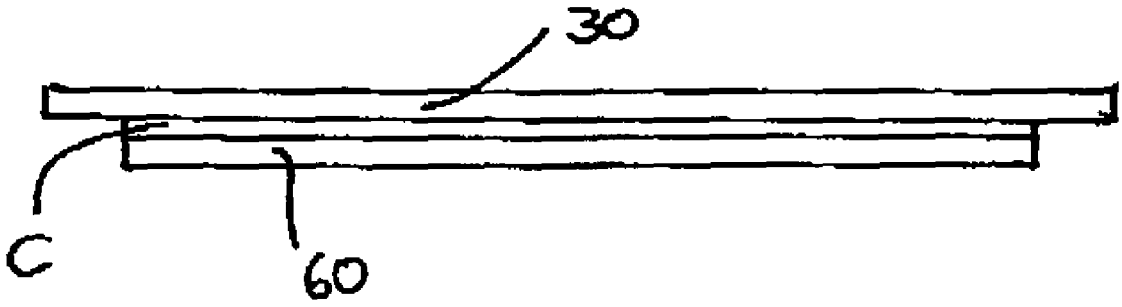
FIG. 5 shows schematically a card between an embossing stencil underneath the card end an embossing stencil on top of the card.

The stencil 60 is inserted into the stencil holder before placing the card C to be processed; subsequently, the card C and an additional stencil (e.g. stencil 30 of FIG. 2) with appropriate pattern are placed into the holder; FIG. 5 shows schematically the arrangement of a card C between the stencils 30 and 60 without showing the holder. By means of a blunt pen the pattern can be embossed into the card by moving the pen along the cutouts.

In the context of the present invention, several variations and further embodiments are possible with regard to, for example, the securing action and alignment of the stencil and stencil holder and/or the article to be processed and the stencil holder.

Instead of the illustrated recesses or depressions, it is also possible to employ projections on the stencil holder which then form stops for the article to be processed. Moreover, in place of the illustrated securing pins, it is possible, for example, to employ clamping devices on the stencil holder for clamping the stencil and/or an article to be processed.

In addition to the adapters for matching the stencil holder to different sizes of articles to be processed, it is also possible to employ an adapter for adjustment of the stencil holder to different stencil shapes or sizes.

The important principle of the invention is that a stencil holder is provided with which a position of the article to be processed and of the stencil are predetermined such that the user is as much as possible relieved of any free choice with regard to the alignment of the pattern relative to the surface to be processed. In this way, an appropriate device can also be used by handicapped people and for therapeutic purposes for mentally impaired people.

Moreover, the present invention also relates to a method for producing "professional" greeting cards and congratulatory cards, certificates and the like, by employing the device of the invention.

While specific embodiments of the invention have been shown and described in detail to illustrate the inventive principles, it will be understood that the invention may be embodied otherwise without departing from such principles.

What is claimed is:

1. A device comprising:

at least one stencil configured to apply a pattern onto a substantially flat surface of an article;

a stencil holder comprising a base member;

wherein the base member of the stencil holder comprises means for securing the at least one stencil in a predetermined position relative to the stencil holder;

wherein the base member of the stencil holder comprises a first recess positively securing within circumferential boundaries of the first recess the surface of the article onto which the pattern is to be applied relative to the stencil holder in a predetermined position relative to the at least one stencil;

wherein the means for securing is positioned outside of the first recess;

wherein the means for securing comprise elements projecting upwardly from the stencil holder;

wherein the at least one stencil has perforations, wherein the elements are short securing pins configured to match the perforations provided in the at least one stencil.

2. The device according to claim 1, further comprising an adapter configured to be inserted into the first recess for reducing a size of the first recess to varying sizes of the surface of the article so that the first recess and the adapter together positively secure the surface of the article.

3. The device according to claim 2, wherein the adapter is configured to adjust the first recess to a standard paper size.

4. The device according to claim 3, wherein the adapter is a bar, an angle piece, a U-shaped frame open at one side, or a circumferentially extending frame.

5. The device according to claim 1, wherein the means for securing comprises a second recess provided in the base member of the stencil holder and surrounding the first recess, wherein the second recess is configured such that, when the at least one stencil is inserted into the second recess, the at least one stencil and the stencil holder form a substantially flush surface.

6. A device comprising:

at least one stencil configured to apply a pattern onto a substantially flat surface of an article;

a stencil holder comprising a base member;

wherein the base member of the stencil holder comprises means for securing the at least one stencil in a predetermined position relative to the stencil holder;

wherein the base member of the stencil holder comprises a recess positively securing within circumferential boundaries of the recess the surface of the article onto which the pattern is to be applied relative to the stencil holder in a predetermined position relative to the at lest one stencil;

wherein the means for securing is positioned outside of the recess;

wherein two of the at least one stencil are provided, wherein the two stencils are embossing stencils and a first one of the embossing stencils is placed into the stencil holder underneath the surface of the article and a second one of the embossing stencils is placed on top of the surface of the article and secured by the means for securing.

7. A stencil holder for at least one stencil for applying a pattern to a surface of an article, the stencil holder comprising:

a base member comprising means for securing the at least one stencil in a predetermined position relative to the stencil holder;

wherein the base member comprises a recess positively securing the surface of the article onto which the pattern is to be applied relative to the stencil holder when placing the article into the first recess;

wherein the means for securing is positioned outside of the recess;

wherein the means for securing comprise elements projecting upwardly from the base member;

wherein the elements are short securing pins configured to match perforations provided in the at least one stencil.

8. The stencil holder according to claim 7, further comprising an adapter configured to be inserted into the recess for reducing a size of the recess to varying sizes of the surface of the article so that the recess and the adapter together positively secure the surface of the article.

9. The stencil holder according to claim 8, wherein the adapter is configured to adjust the recess to a standard paper size.

10. The stencil holder according to claim 9, wherein the adapter is a bar, an angle piece, a U-shaped frame open at one side, or a circumferentially extending frame.

11. A stencil holder for at least one stencil for applying a pattern to a surface of an article, the stencil holder comprising:

a base member comprising means for securing the at least one stencil in a predetermined position relative to the stencil holder;

wherein the base member comprises a recess positively securing the surface of the article onto which the pattern is to be applied relative to the stencil holder when placing the article into the recess;

wherein the means for securing is positioned outside of the recess;

wherein the means for securing comprise elements projecting upwardly from the base member;

wherein the base member has receiving openings and wherein the elements projecting upwardly from the base member are insertable into the receiving openings in different arrangements.

12. The stencil holder according to claim 11, further comprising an adapter configured to be inserted into the recess for reducing a size of the recess to varying sizes of the surface of the article so that the recess and the adapter together positively secure the surface of the article.

13. The stencil holder according to claim 12, wherein the adapter is configured to adjust the recess to a standard paper size.

14. The stencil holder according to claim 13, wherein the adapter is a bar, an angle piece, a U-shaped frame open at one side, or a circumferentially extending frame.

15. A method for applying a pattern onto a substantially flat surface by using a device comprising at least one stencil configured to apply a pattern onto a substantially flat surface of an article; a stencil holder; wherein the stencil holder comprises means for securing the at least one stencil in a predetermined position relative to the stencil holder; wherein the stencil holder comprises a recess positively securing the surface of the article onto which the pattern is to be applied relative to the stencil holder, wherein the means for securing is positioned outside of the recess; the method comprising the steps of:

inserting the surface of the article into the stencil holder and positively securing the surface in a predetermined position relative to the stencil holder in the recess by circumferential boundaries of the recess;

placing a first stencil onto the stencil holder and the surface of the article in a predetermined position relative to the stencil holder; and applying a pattern provided by the first stencil onto the surface of the article;

placing a second stencil into the stencil holder before inserting the surface of the article into the stencil holder, wherein the first and second stencils are embossing stencils and in the step of applying a pattern an embossed pattern is created.

16. The method according to claim 15, further comprising the step of placing an adapter into the recess before the step of inserting for reducing a size of the recess to the surface of the article so that the recess and the adapter together positively secure the surface of the article.

* * * * *